US005385267A

United States Patent [19]

Diamond et al.

[11] Patent Number: 5,385,267

[45] Date of Patent: Jan. 31, 1995

[54] PORTABLE DISPENSER FOR GENERALLY SPHERICAL CONFECTIONERIES

[75] Inventors: Sidney Diamond, Chicago; Dennis Kupperman, Glenview, both of Ill.

[73] Assignee: Sidney Diamond/Imaginings 3, Inc., Niles, Ill.

[21] Appl. No.: 138,593

[22] Filed: Oct. 18, 1993

[51] Int. Cl.[6] ..... B65G 59/00

[52] U.S. Cl. ..... 221/248; 221/190; 221/24

[58] Field of Search ..... 221/248, 247, 187, 186, 221/289, 190, 269, 293, 229, 24, 151, 152

[56] References Cited

U.S. PATENT DOCUMENTS

| | | | |
|---|---|---|---|
| 1,038,570 | 9/1912 | Gulland | 221/248 |
| 1,262,055 | 4/1918 | Johnson | 221/196 |
| 1,395,388 | 11/1921 | Byer | 221/204 |
| 1,574,071 | 2/1926 | Dvorsky | 221/24 |
| 1,725,965 | 8/1929 | Ormiston | 221/24 |
| 2,072,640 | 3/1937 | Levy | 312/92 |
| 2,233,120 | 2/1941 | Andonov | 221/190 |
| 2,431,219 | 11/1947 | Zanardo | 312/78 |
| 2,531,300 | 11/1950 | Schloer | 221/190 |
| 2,597,990 | 5/1952 | Hellman | 312/47 |
| 2,620,061 | 12/1952 | Uxa | 206/42 |
| 2,699,349 | 2/1954 | Silver | 206/42 |
| 2,853,206 | 9/1958 | Uxa | 221/229 |
| 3,021,981 | 2/1962 | Mannik | 221/202 |
| 3,263,860 | 8/1966 | Haas | 221/274 |
| 3,410,455 | 11/1968 | Haas | 221/229 |
| 3,565,284 | 2/1971 | Hinterreiter | 221/229 |
| 3,942,683 | 3/1976 | Haas | 221/229 |
| 4,295,579 | 10/1981 | Haas | 221/229 |
| 4,311,251 | 1/1982 | Sternberg | 221/24 |
| 4,767,023 | 8/1988 | Hackmann et al. | 221/248 |
| 4,966,305 | 10/1990 | Hinterreiter | 221/229 |
| 5,054,649 | 10/1991 | Lemaine et al. | 221/248 |
| 5,071,033 | 12/1991 | Siwek | 221/247 |

*Primary Examiner*—Kenneth W. Noland
*Attorney, Agent, or Firm*—Dick and Harris

[57] ABSTRACT

A portable dispenser for spherical confectioneries such as gumballs has a clear tubular reservoir that is movable with respect to a base. Within a substantially hollow interior of the base, a pivoting ramp is mounted to receive a single gumball and convey it to an opening in the base while blocking other gumballs from dropping out of the tubular reservoir. Mounted for pivotal movement adjacent a free end of the ramp is a door for closing the opening in the base as the ramp itself pivots to convey the gumball toward the opening. Adjacent the bottom of the tubular reservoir are a pair of actuators that lock the tubular reservoir to the base for limited movement relative to the base. The actuators engage the ramp upon the tubular reservoir being moved toward the base. An integrally formed spring on the bottom of the ramp biases the ramp and biases the tubular reservoir away from the base. Adjacent the top of the tubular reservoir is a pivotally mounted head for capping the tubular reservoir. The head may conveniently be styled as a licensed character and indications are provided to facilitate proper rotational alignment with the other components.

28 Claims, 2 Drawing Sheets

175
10
155
145
12
125
15
115
65
4
2
3
176
170
166
156
146
162
130
128
148
132
18
40
136
138
97
129
96
52
54
26
102
104
56
106
110
90
68
84
34
112
92
70
180
158
160
182
164
178
150
140
42
44
50
22
24
58
59
120
108
126
30
81
80
122
124
88

PORTABLE DISPENSER FOR GENERALLY SPHERICAL CONFECTIONERIES

BACKGROUND OF THE INVENTION

1. Field of the Invention

This invention relates generally to confectionery dispensing devices and more particularly to portable dispensers for generally spherical confectioneries such as gumballs and jawbreaker candies.

2. Background Art

Confectioneries, particularly candy and gum, have long been popular with children and adults alike. Dispensers of individual pieces or small quantities of confectioneries are particularly popular with children. Numerous of such devices exist in which a coin must be inserted for the device to dispense a piece of candy or gum. Indeed, a popular form of savings banks for children are gumball dispensers which require the child to deposit a coin before being able to obtain a gumball. Many devices for dispensing confectioneries, while portable in the sense that they may be moved from one location to another, are not readably carried upon the person of the user. There have, however, been portable, handheld devices for the dispensing of individual flat, generally rectangular solid, pieces of candy. Examples of such candy dispensers in which the upper portion of a handheld dispenser is manipulated to eject a piece of candy from adjacent the top of a magazine containing a number of upwardly spring biased pieces are shown in Uxa U.S. Pat. No. 2,620,061 issued Dec. 2, 1952; Uxa U.S. Pat. No. 2,853,206 issued Sep. 23, 1958; Haas U.S. Pat. No. 3,410,455 issued Nov. 12, 1968; Hinterreiter U.S. Pat. No. 3,565,284 issued Feb. 23, 1971; Haas U.S. Pat. No. 3,942,683 issued Mar. 9, 1976; Haas U.S. Pat. No. 4,295,579 issued Oct. 20, 1981 and Haas U.S. Pat. No. 4,966,305 issued Oct. 30, 1990. Such devices require manipulation of the top of the dispenser by the user's hand holding the dispenser or a finger or the thumb of the other hand. Haas U.S. Pat. No. 3,263,860 issued Aug. 2, 1966 discloses another type of dispenser for such flat pieces of candy carried in a rearwardly angled hopper for ejection through an opening adjacent the bottom of the hopper. Ejection is accomplished by a mechanism carried in a base atop which the hopper is mounted. The ejection mechanism is a spring biased linkage that operates upon depression by the user of a bar that is exposed through the top of the base adjacent the hopper opening to move a pair of ejector arms through openings in the back of the hopper to push a single piece of the flat candy out the opening. In addition to requiring a base that is large relative to the piece of candy being dispensed in order to house the ejector linkage, this prior art dispenser would be difficult to use with generally spherical confectioneries as they would tend to roll out the opening at the bottom of the hopper even prior to a user actuating the ejector linkage. Accordingly, there remains a need for a portable, handheld dispenser of generally spherical confectioneries such as gumballs and jawbreaker candies which may be readably carried upon the person of the user and readily actuated in any number of ways to dispense a single piece of a generally spherical confectionery without requiring any particular proficient digital dexterity.

SUMMARY OF THE INVENTION

The present invention is concerned with providing a portable dispenser for generally spherical confectioneries such as gumballs or the like. The dispenser includes a reservoir having an open top and an open bottom for inserting gumballs into the reservoir and dispensing them from the reservoir. A movable cap is carried adjacent the top of the reservoir and positionable in register with the top opening to seal it against the passage of gumballs. The dispenser also includes a base with a substantially hollow interior and having a bottom and a top. An opening adjacent the top of the base permits passage of the gumball while a cover member is adjacent the bottom of the base. Provision is made for mounting the bottom of the reservoir adjacent the top of the base member with the bottom opening of the reservoir in register with the opening adjacent the top of the base to permit gumballs to pass between the reservoir and the hollow interior of the base member. An opening is provided in the peripheral wall of the base member for dispensing a gumball and a door is mounted for movement between a position closing the opening and one permitting dispensing of the gumball through the opening. The reservoir is movable with respect to the base and biased away from the base. Movement of the reservoir toward the base, against the bias, effects movement of the door from the position closing the dispensing opening.

BRIEF DESCRIPTION OF THE DRAWINGS

For a better understanding of the present invention, reference may be had to the accompanying drawings in which:

FIG. 9(*b*) is another fragmentary sectional view showing another stage of the dispensing operation;

FIG. 9(*c*) is yet another fragmentary sectional view showing a further stage of the dispensing operation;

FIG. 9(*d*) is still another fragmentary sectional view showing the device returning toward the initial position after dispensing a piece of generally spherical confectionery.

DETAILED DESCRIPTION

Figures 1, 2, 3:
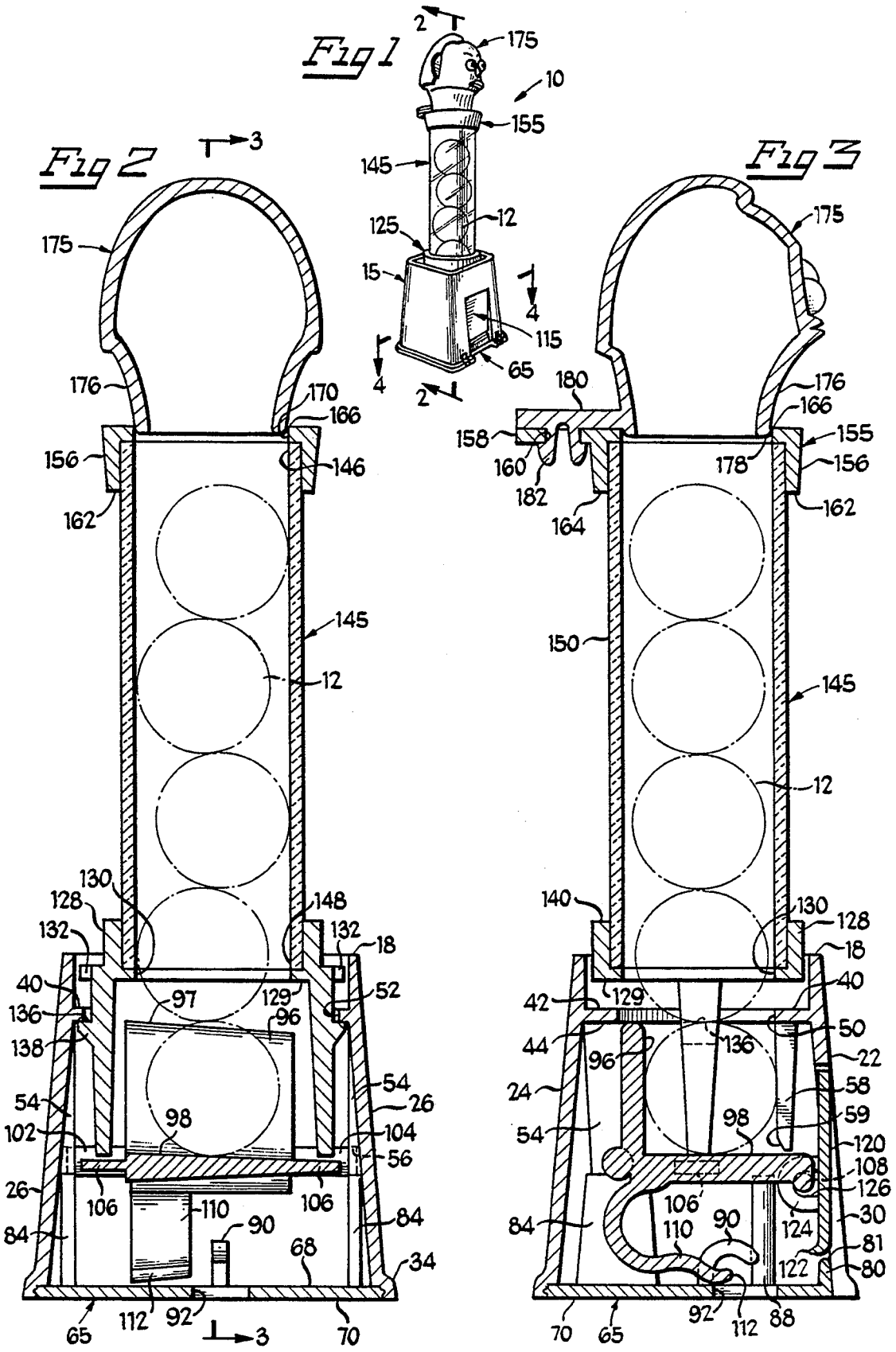
FIG. 1 is a perspective view of an embodiment of the present invention.
FIG. 2 is an enlarged scale, sectional view taken generally along line 2—2 of FIG. 1.
FIG. 3 is an enlarged scale, sectional view taken generally along line 3—3 of FIG. 2.

Referring now to the drawings in which like parts are designated by like reference numerals throughout the several views, there is shown in FIG. 1 a portable dispenser 10 for generally spherical confectioneries such as gumballs 12. Dispenser 10 may conveniently be made of a size that may be readily carried upon the person of the user in which case the dispenser would be approximately 4.7 inches high and just over 1.5 inches wide at its widest point. A dispenser of the size described would accommodate five gumballs 12, each having an approximate average diameter of 0.555 inches. However, a dispenser according to the present invention is not so limited as to size, and may readily be made of any greater desired height as will be later indicated in more detail.

Figure 7:
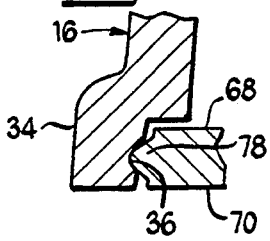
FIG. 7 is a fragmentary, enlarged scale sectional view of the juncture of the base and bottom plate.
Figure 9C:
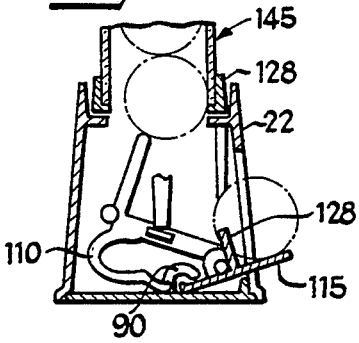

Dispenser 10 has a base member 15 that is a generally truncated, substantially hollow interior, pyramid with a four sided peripheral wall 16 having a top 18 and an open bottom 20. Peripheral wall 16 includes a front wall 22, an opposed back wall 24 and spaced apart, opposed transverse side walls 26. Front wall 22 has a generally trapezoidal opening 30, of a size sufficient to permit the passage of gumballs 12, approximately centrally disposed between side walls 26 and extending upwardly from bottom 20. On either side of opening 30, also extending upwardly from bottom 20, are small slots 32. Around bottom 20 of peripheral wall 16 is an outwardly angling foot portion 34, the details of which are best illustrated in FIGS. 2 and 7. Foot portion 34 strengthens bottom 20 and provides a seat for a cover for the open bottom. On the inside of foot portion 34 is a groove 36 that extends around the entirety of peripheral wall 16, except of course for opening 30 and slots 32.

Adjacent top 18 is a recessed ledge 40 that has an upper surface 42 and a lower surface 44. Upper surface 42 is recessed downwardly from top 18 to form a well 46. Generally centrally disposed in and extending through ledge 40 is a generally circular opening 50 of a diameter sufficient to permit passage of gumballs 12. Also extending through ledge 40 are a pair of spaced apart, generally rectangular slots 52. One of each of slots 52 is, as is perhaps best illustrated in FIG. 5, disposed on either side of opening 50 between the periphery of opening 50 and the side edge of ledge 40 adjacent a respective one of side walls 26.

Depending downwardly from lower surface 44 of ledge 40 are a pair of spaced-apart struts 54, one adjacent each side edge of ledge 40 adjacent a respective one of side walls 26 and both disposed adjacent back wall 24. On the bottom of each strut 54 is a semi-circular cut-out 56 that aligns with semi-circular cut-out 56 of the other strut 54. Also depending from lower surface 44 of ledge 40 are a pair of spaced-apart guide rods 58. Each of guide rods 58 are disposed more proximate front wall 22 with the back edge of each guide rod 58 being approximately along a line tangent the forwardmost edge of opening 50. Laterally, each of guide rods 58 are disposed adjacent opening 30 and approximately along a line tangent each sidemost edge of opening 50. At their lower back edge, each guide rod 58 is provided with an angled surface 59.

Thus, it will be appreciated that base member defines a substantially hollow interior into and from which gumballs 12 may pass through either opening 30 or opening 50. As formed and described thus far, base member 15 does have another opening namely, its entire bottom. To close the bottom of base member 15, a cover member 65 is provided.

Cover member 65 includes a cover plate 66 which is of a generally rectangular, rounded corner configuration conforming to the bottom of base member 15. Plate 66 has an upper surface 68 and a bottom surface 70, a front 72, a back 74 and opposed transverse sides 76. Extending around the outer periphery of cover plate 66, generally centrally disposed between upper surface 68 and bottom surface 70 is a bead 78. The outer dimensions of cover plate 66 generally conform to the inside dimensions of the bottom of base 25 member 15, more particularly to the inside of foot portion 34. Accordingly, when cover member 65 is seated into the bottom of base member 15, there is an interference fit with bead 78 fitting into groove 36 to secure cover member 65 and the bottom of base member 15.

Extending upwardly from adjacent front 72, but recessed inwardly, is a relatively low sill 80 of a length approximately equal to the width of the bottom of opening 30. Sill 80 has a rounded upper edge 81. When cover member 65 is assembled to base member 15, upper edge 81 of sill 80 fits across the bottom of opening 30 in peripheral wall 16. On either side of the ends of sill 80 and inboard of each respective side 76 are both upwardly and outwardly extending L-shaped lugs 82. Each of lugs 82 fits into a respective one of slots 32 in front wall 22 of base member 15. Lugs 82 in slots 32 tend to overcome any tendency of peripheral wall 16 to flex outwardly near the bottom and permit cover member 65 to fall out, particularly along front wall 22 which is less rigid because of opening 30.

Adjacent a respective side 76 and adjacent back 74 is a pair of spaced-apart supports 84 extend upwardly from upper surface 68. Each of supports 84 is disposed so as to align with a respective one of depending struts 54 of base member 15. Also extending upwardly from upper surface 68 is a pair of spaced-apart pins 88. Each of pins 88 is laterally disposed on either side of sill 80, generally aligned with depending guide rods 58, and between the center of cover member 65 and sill 80, rearward of depending guide rods 58. Projecting upwardly from surface 68 of cover plate 66, generally laterally centrally disposed and more proximate to sill 80 than to back 74, is an inverted J-shaped hook 90. To facilitate molding J-shaped hook 90 as an integral part of cover member 65 an opening 92 is provided for a core (not shown).

Mounted for pivotal movement within the assembly of base member 15 and cover member 65 is a generally L-shaped ramp member 95 for receiving a single gumball 12 and conveying the single gumball to opening 30. Ramp member 95 includes a generally vertical blocking portion 96 with an angled top edge 97 and a substantially transverse, generally horizontal, receiving portion 98. As is perhaps best illustrated in FIGS. 4 and 5, receiving portion 98 has a forward, free end 100, which is stepped-down in width and an angled front edge 101. The purpose of the angled top edge and angled front edge is to facilitate extraction of ramp member from the mold.

Extending out laterally adjacent the intersection of portion 96 and 98 are shafts 102 and 104. As shown in the drawings shaft 102 is conical while shaft 104 is cylindrical. The conical shape, or more correctly truncated conical shape, of shaft 102 is also to facilitate extraction of ramp member 95 from the mold. Each of the shafts is supported for rotation between a respective set of a support member 84 and a downwardly depending strut 54, within the arcuate cut-out 56. Also extending out laterally from the sides of the wider part of receiving portion 98 are a pair of engagement tabs 106. A pair of pins 108 extend out laterally from adjacent forward free end 100.

Figure 4:
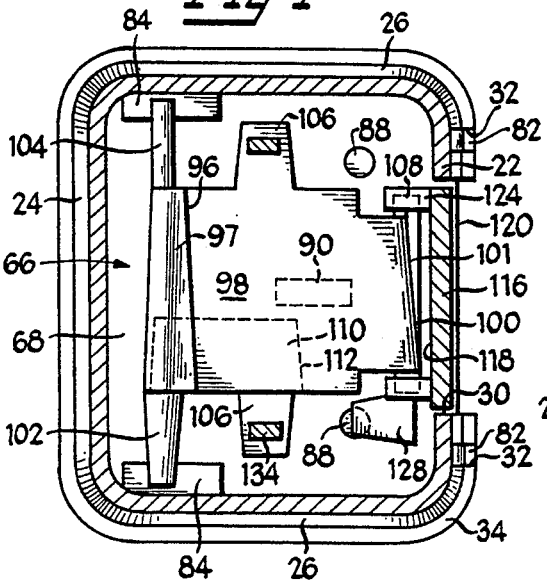
FIG. 4 is an enlarged scale, sectional view taken generally along line 4—4 of FIG. 1.
Figure 9A:
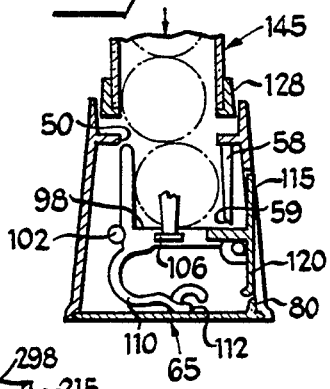
FIG. 9(*a*) is a fragmentary sectional view, similar to that of FIG. 2, prior to initiation of the dispensing operation.
Figure 5:
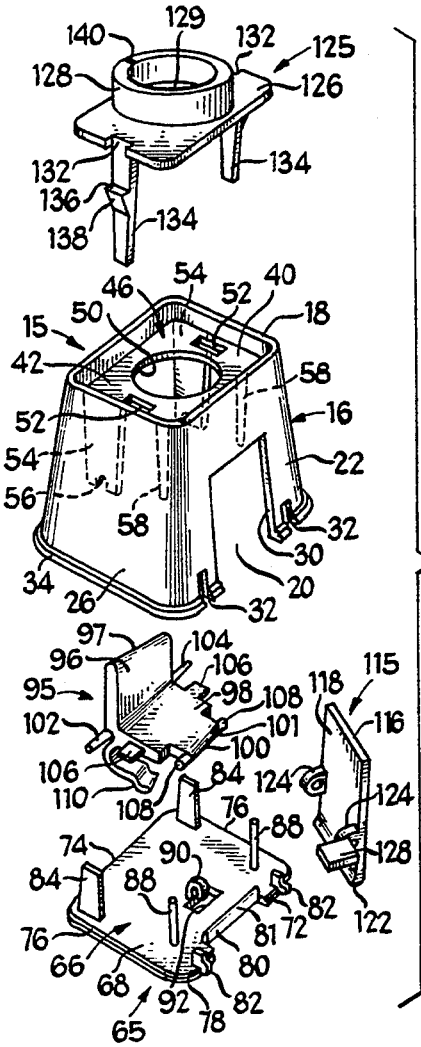
FIG. 5 is an enlarged scale, exploded perspective view of an assembly of some of the parts.
Figure 8:
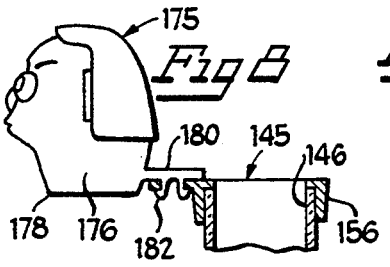
FIG. 8 is a fragmentary view, partially in section, showing the cap rotated out of register with the opening adjacent the top of the reservoir.
Figure 9D:
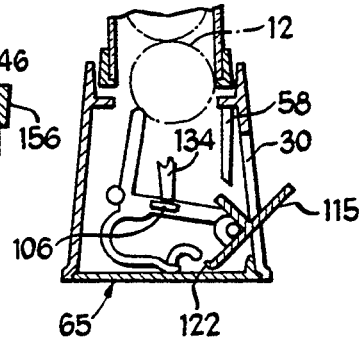

Integrally formed with and depending downwardly from receiving portion 98 is a spring 110. As is best seen in FIGS. 2, 4 and 5, spring 110 is disposed to one side of the lateral center of ramp member 95, more particularly to the left side as viewed from forward free end 100. Spring 110 is a curved leaf spring with a free front end 112. Although preferably integrally formed, spring 110 could be separately made and attached to receiving portion 98. With ramp member 95 mounted for pivotal movement about the axes of shafts 102 and 104, free end 112 rests upon upper surface 68 of cover member 65 biasing ramp member 95 to the position illustrated in FIGS. 2, 3 and 9(*a*) with receiving portion 98 generally horizontal.

Figure 10:
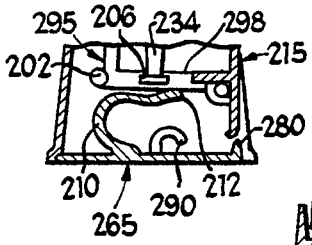
FIG. 10 is a perspective view of an alternative embodiment of the present invention.
Figure 9B:
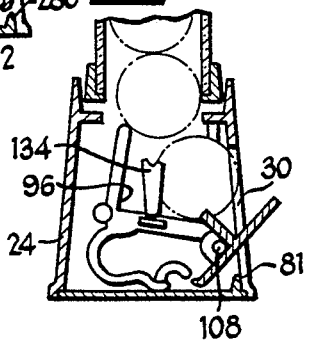
Figure 6:
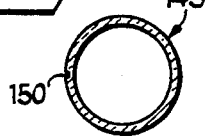
FIG. 6 is a fragmentary, cross-sectional view of the reservoir.

An alternative embodiment is illustrated in FIG. 10 in which the spring is intregrally formed as part of the cover member rather than as the ramp member. In this alternative embodiment, a cover member 265 has an integrally formed spring 210 with a free front end 212. Spring 210, or particularly free front end 212, bears against the underside of a ramp member 295, or more particularly the horizontal receiving portion 298. In all other respects, the alternative embodiment is the same as the embodiment shown in FIGS. 1 through 9. Thus, in the alternative embodiment shown in FIG. 10 there is an upwardly projecting inverted J-shaped hook 290 on cover member 265 similar to hook 90 and the cover member has a sill 280 similar to sill 80. Ramp member 295 pivots about a pair of shafts, similar to shafts 102 and 104, only one of which, namely shaft 202 is shown in FIG. 10. Ramp member 295 also has engagement tabs 206 similar to engagement tabs 106 and will be actuated by actuators 234 in the same manner as will be described with respect to the embodiment of FIGS. 1–10. As a further alternative (not shown) the spring may be a separate piece from both the ramp member and the cover member.

A door member 115 is provided for closing opening 30. Door member 115 includes a generally trapezoidal door portion 116 having dimensions less than that of opening 30 so as to readily fit within opening 30 while substantially closing the opening. Door portion 116 has an inner surface 118 and an outer surface 120. At its lower free end, door portion 116 is formed with an inwardly directed lip 122. Extending inwardly from inner surface 118, adjacent each side of door portion 116 are a pair of spaced-apart mounting tabs 124 each having a circular bore 126. Also extending inwardly from adjacent one side of door portion 114 adjacent to the upper part of one of the mounting tabs 124 is an inwardly extending rib 128.

Door member 115 is mounted for pivotal movement about the axis of pins 108 of ramp member 95. With ramp member 95 in its at rest, pre-dispensing position as illustrated in FIGS. 2, 3 and 9(*a*), rib 128 rests upon the adjacent one of pins 88 and the adjacent one of depending guide rods 58 abuts the top of rib 128. As ramp member 95 pivots about the axes of shafts 102 and 104 with free front end 100 pivoting downwardly in a clockwise direction, door member 115 will pivot from the closed position illustrated in FIG. 9(*a*) through the position indicated in FIG. 9(*b*) to the open position illustrated in FIG. 9(*c*). With door member 115 in its fully open position, as illustrated in FIG. 9(*c*), lower lip 122 fits under and engages inverted J-shaped hook 90. During the opening of door member 115, tab 128 pivots out of engagement with the adjacent pin 88 and will, facilitated by angled surface 59, clear the adjacent guide rod 58. As ramp member 65 is permitted to return to its at rest position under the bias of spring 110, hook 90 will continue to engage lip 122 and thus directs door member 115 in properly pivoting back to its closing position of opening 30.

Received in well 46 is an ejector flange member 125 that has a generally rectangular mounting plate 126 that fits into well 46 and bottoms on the upper surface 42 of ledge 40. Extending upwardly from plate 126 is a tubular collar 128 with a ledge 129 surrounding a generally circular opening 130 in plate 126. In each side edge of plate 126 is a notch 132. Depending downwardly from plate 126 on each side of the plate, generally aligned with a respective one of notches 132, is a downwardly depending actuator 134. Notches 132 are provided in plate 126 to facilitate the integrally molding of actuators 134. Projecting laterally outwardly from each of actuators 134 is a detent 136 having an angled cam surface 138. At the back of collar 128 is a mark 140 indicating the center of the collar.

Each of actuators 134 fit through a respective one of slots 52 in ledge 40. As ejector flange member 125 is initially inserted and pushed downwardly, each of actuators 134 will flex inwardly a sufficient amount to permit the forced insertion of detent 136, facilitate by the angled cam surface 138, through slots 52. Once detent 136 passes through slot 52 of ledge 40 the inherent resiliency of actuators 134 will urge detents 136 outwardly such that they will engage lower surface 44 of ledge 40 to prohibit the removal of ejector flange member 125 from base member 15. With ejector flange 125 positioned on base member 15, more particularly in well 46, opening 130 of ejector flange member 125 is aligned with opening 50 extending through ledge 20 to permit the passage of gumballs 12 into the substantially hollow interior of base member 15.

Secured in tubular collar 130 is a tubular reservoir member 145 of a preselected length. Reservoir member is conveniently made of a transparent plastic material to show gumballs 12. The inside diameter of reservoir member 145 is approximately 0.655 inches so as to readily accommodate gumballs or other spherical confectioneries having an approximate average diameter of 0.555 inches. A height of approximately 2.2 inches for the tubular reservoir allows the dispenser to accommodate, with the one gumball contained in the substantially hollow interior of base member 15, a total of five gumballs 12. However, particularly as the tubular reservoir may readily be extruded and cut into any preselected length, the length may be made longer to accommodate more gumballs 12. Such an increase in the length of reservoir member 12, while desirable from the standpoint of increasing the capacity of dispenser 10, does increase the overall height of the dispenser and affect its portability. Adjacent its top, reservoir member 145 has an opening 146 and, adjacent its bottom, reservoir 145 has an opening 148 to permit passage of gumballs 12 into and out of the tubular reservoir. Along its exterior, tubular reservoir member 145 is provided with a shallow extruded channel 150 along its entire length.

Secured atop tubular reservoir member 145 is a cap or head mounting flange member 155 with a tubular collar 56. The inside diameter of each of collars 128 and 156 is such that there is an interference fit with tubular reservoir member 145. Extending laterally from collar 156 is a mounting tab 158 with an aperture 160. On its lower edge 162, collar 156 is conveniently provided with a mark 164 that represents the center of tab 158 and its aperture 160. Thus, each of cap or head mounting flange member 155, tubular reservoir 145 and ejector flange member 125 may be readily aligned by means of marks 164 and 140 with channel 150. With the flange members and tubular reservoir member aligned, a small drop of adhesive is used to prevent any relative rotational movement of the pieces which would disrupt the alignment. Collar 156, or more particularly its inner upper edge 166, defines an opening 170 that permits the passage of gumballs 12.

Conveniently, each of base member 15, cover member 65, ramp member 95, door member 115, ejector flange member 125 and mounting flange member 155 may be made of the same material in a single mold. The most significant factor in determining the material choice is the repeated flexing of integral spring 110. As the relative movement between ejector flange member 125 and base 15 is relatively small, approximately an eighth of an inch in the embodiment described, it will be appreciated that there is not a lot of flexing of spring 110. Accordingly, suitable materials for this embodiment include ABS plastic or a more economical high impact styrene. As an alternative, these parts, in addition to tubular reservoir member 145, could be made of a transparent plastic so that the user may observe the operation of the dispenser 10. Phillips K-resin would be a suitable transparent plastic for this purpose. As previously indicated, spring 110 need not be made integral with ramp member 95 or integral with alternative cover member 265. The spring could be separately made of metal and secured to the ramp member or to the cover member by any one of conventional methods such as staking. Indeed, the spring could even be an entirely separate piece that merely bears against both the ramp member and the cover member without being attached to either.

Mounted atop dispenser 10 or more particularly atop cap or head flange mounting member 155, for rotational movement relative to it, is a cap or head member 175 having a depending neck 176. Head member 175 may conveniently be formed to represent the head of a readily recognizable licensed character or a design of any other choosing. Neck 176 is generally circular with an outer diameter sufficient to fit into opening 170 of head mounting flange member 155. At its bottom, more particularly, along its bottom outside edge, neck 176 is provided with a rounded surface 178. Extending rearwardly from adjacent the lower back end of neck 176 is a mounting arm 180 having an integrally formed, downwardly depending, bifurcated barb member 182. To assemble head member 175 to mounting flange member 155, the free ends of bifurcated barb member 182 are compressed and inserted in aperture 160 in tab 158.

As is perhaps best illustrated in FIG. 3, neck 176 depends below mounting arm 180 a distance sufficient to securely seat head member 175 within opening 170 of collar 156 in order to prevent inadvertent rotational dislocation of head member 175. In the position illustrated in FIGS. 1, 2 and 3, head member 175 caps tubular reservoir member 145 and seals gumballs 12 within the reservoir member. To permit access to reservoir member 145, head member 175 is rotated or pivoted approximately one hundred eighty degrees to the position illustrated in FIG. 8 to provide ready access for the introduction of additional gumballs into reservoir member 145. As head member 175 is pivoted from its position in register with openings 178 and 146, rounded cam surface 178 bears against upper edge 166 to cam or deflect the depending portion of neck 176 out of opening 170. In an alternative embodiment (not shown) in which head member 175 is much larger because of a character design, the neck may fit around the outside of collar 156 rather than into opening 170. In such an alternative, the inside edge of the neck would be rounded and would cam against the outer upper edge of collar 156 rather than its inner upper edge.

In operation, with a supply of gumballs 12 within tubular reservoir member 145 and head member 175 in the reservoir closing position, a force is exerted to move head member 175, mounting flange member 155, reservoir member 145 and ejector flange 125 closer to ledge 40 at the bottom of well 46 against the opposing bias of spring 110. Such relative movement may be readily accomplished in a number of ways. For example, base member 15, or more particularly the underside 70 of cover member 65 may be placed on a relatively solid surface and a downward force exerted on top of head member 175. Alternatively, base member 15 may again be rested upon a substantially solid surface and reservoir member 145 may be grasped and pushed down. As a further alternative, the dispenser may be compressed between two hands of the user or between the thumb and forefinger of one hand.

When ejector flange member 125 is pushed down into well 46 of base member 15, ejectors 134 will engage ejector tabs 106 causing ramp member 95 to pivot about the axes of shafts 102 and 104 against the bias of spring 110 as previously described. The gumball then positioned on receiving portion 98 will roll forwardly and downwardly toward free front end 100 of ramp member 95 and opening 30. Again, as previously described, the pivotal movement of ramp member 95 will cause door member 115 carried by ramp member 95 to pivot from its position closing opening 30 to the open dispensing position illustrated in FIG. 9(*c*) with the gumball supported on inner surface 118 of door 115 and receiving portion 98, more particularly free front end 100, of ramp member 95. The user may then manually remove the dispensed gumball.

The pivotal movement of ramp member 95 as ejector flange member 125 is pushed downwardly into well 46, also results in the pivotal movement of blocking portion 96 from its generally vertical position prior to the initiation of the dispensing sequence shown in FIGS. 3 and 9(*a*) to positions in which portion 96 blocks opening 50 and prevents the passage of another gumball into the substantially hollow interior of base member 15. When the pressure overcoming the bias of spring 110 and urging ejector flange member 125 into well 46 is released, the bias of spring 110 will cause ramp member 125 to pivot back in a counterclockwise rotation as illustrated in FIG. 9(*d*) permitting another gumball 12 to drop down into the interior of base member 15 and rest upon receiving portion 98 in readiness for another dispensing sequence.

While a particular embodiment of the present invention has been shown and described with some alternatives, it will be apparent that further changes and alternatives, will occur to those skilled in the art. It is intended in the appended claims to cover all such changes and modifications as fall within the true spirit of the scope of the present invention.

What is claimed as new and desired to be secured by Letters Patent is:

1. A portable dispenser for generally spherical confectioneries comprising in combination:

a reservoir capable of containing a number of generally spherical pieces of confectionery;

the reservoir having a top and a bottom:

an opening adjacent the top of the reservoir permitting passage of the confectionery pieces;

an opening adjacent the bottom of the reservoir permitting passage of the confectionery pieces;

a movable cap carried adjacent the top of the reservoir and being positionable in register with the opening adjacent the top of the reservoir to prohibit passage of the confectionery pieces through the opening adjacent the top of the reservoir;

a base member having a substantially hollow interior;

the base member having a bottom and a top;

an opening adjacent the top of the base member permitting passage of the confectionery pieces;

a cover member adjacent the bottom of the base member;

means for mounting the bottom of the reservoir adjacent the top of the base member with the opening adjacent the bottom of the reservoir in register with the opening adjacent the top of the base member to permit confectionery piece passage between the reservoir and the hollow interior of the base member;

the base member having a peripheral wall extending between the bottom and the top of the base member;

an opening in the peripheral wall of the base member permitting passage of the confectionery pieces for dispensing;

means for closing the opening in the peripheral wall of the base member mounted for movement between a closed position prohibiting the passage of the confectionery pieces through the opening in the peripheral wall of the base member and an open position permitting the passage of the confectionery pieces through the opening in the peripheral wall of the base member; the reservoir being movable with respect to the base;

means for biasing the reservoir away from the base; and means for moving the means for closing the opening in the peripheral wall of the base member from the closed position to the open position in response to movement of the reservoir toward the base in opposition to the means for biasing the reservoir away from the base.

2. The portable dispenser for generally spherical confectioneries of claim 1 in which the reservoir includes:

an elongated hollow piece having a top and a bottom;

an upper flange adjacent the top of the elongated hollow piece; and a lower flange adjacent the bottom of the elongated hollow piece.

3. The portable dispenser for generally spherical confectioneries of claim 2 in which:

the elongated hollow piece is a cylindrical tube; and each of the cylindrical tube, upper flange and lower flange bear means for indicating a particular circumferential position for relative rotational alignment of each of the tube, upper flange and lower flange.

4. The portable dispenser for generally spherical confectioneries of claim 3 in which the cylindrical tube and each of the upper and lower flanges are secured adjacent the top and bottom of the tube, respectively, with means for preventing rotational movement of either of the flanges relative to the tube.

5. The portable dispenser for generally spherical confectioneries of claim 2 in which:

the upper flange has a tab;

the movable cap has a tab; and means for mounting the movable cap fasten the cap tab to the upper flange tab for pivotal movement of the movable cap with respect to the upper flange.

6. The portable dispenser for generally spherical confectioneries of claim 5 in which:

the upper flange has an upper edge;

the movable cap has a depending portion that engages the upper edge of the upper flange when the movable cap is in register with the opening adjacent the top of the reservoir to prohibit passage of the confectionery pieces through the opening adjacent the top of the reservoir; and the depending portion of the movable cap is movable out of engagement with the upper edge of the upper flange to permit the movable cap to be pivoted out of register with the opening adjacent the top of the reservoir.

7. The portable dispenser for generally spherical confectioneries of claim 6 in which the depending portion of the movable cap that engages the upper edge of the upper flange is provided with a cam surface that will bear against the upper flange and deflect the depending portion out of engagement with the upper edge of the upper flange when a pivotal force is exerted upon the movable cap to move it out of register with the opening adjacent atop of the reservoir.

8. The portable dispenser for generally spherical confectioneries of claim 1 in which means for receiving a single confectionery piece from the reservoir and for conveying the single confectionery piece to the opening in the peripheral wall of the base member is mounted for movement within the substantially hollow interior of the base member.

9. The portable dispenser for generally spherical confectioneries of claim 8 in which:

the means for receiving and conveying the single confectionery piece includes a generally L-shaped member;

generally transverse first and second portions form the L-shape; and the generally L-shaped member is mounted for pivotal movement about an axis generally parallel to the intersection of the generally transverse first and second portions.

10. The portable dispenser for generally spherical confectioneries of claim 9 in which one of the first or second portions of the L-shaped member blocks the passage of the confectionery pieces through the opening adjacent the top of the base member as the L-shaped member moves and the other of the first or second portions conveys the single confectionery piece to the opening in the peripheral wall.

11. The portable dispenser for generally spherical confectioneries of claim 8 in which the means for closing the opening in the peripheral wall of the base member is carried by the means for receiving and conveying the single confectionery piece.

12. The portable dispenser for generally spherical confectioneries of claim 8 in which the means for closing and opening the peripheral wall of the base member is carried by the means for receiving and conveying the single confectionery piece for pivotal movement relative to the means for receiving and conveying the single confectionery piece.

13. The portable dispenser for generally spherical confectioneries of claim 8 in which the means for biasing the reservoir away from the base engages the means for receiving and conveying the single confectionery piece and the cover member adjacent the bottom of the base member.

14. The portable dispenser for generally spherical confectioneries of claim 13 in which the means for biasing the reservoir away from the base is carried by the means for receiving and conveying the single confectionery piece and engages the cover member adjacent the bottom of the base member.

15. The portable dispenser for generally spherical confectioneries of claim 14 in which the means for biasing the reservoir away from the base is integrally formed with the means for receiving and conveying the single confectionery piece.

16. The portable dispenser for generally spherical confectioneries of claim 13 in which the means for biasing the reservoir away from the base is carried by the cover member adjacent the bottom of the base member and engages the means for receiving and conveying the single confectionery piece.

17. The portable dispenser for generally spherical confectioneries of claim 16 in which the means for biasing the reservoir away from the base is integrally formed with the cover member adjacent the bottom of the base member.

18. The portable dispenser for generally spherical confectioneries of claim 1 in which:

the cover member is assembled to the base member; and means for stabilizing the assembly of the cover member to the base member are carried on each of the cover member and the base member.

19. The portable dispenser for generally spherical confectioneries of claim 18 in which the means for stabilizing the assembly of the cover member and the base member includes:

a lower integral portion forming part of the peripheral wall;

a groove in the lower internal portion;

a peripheral edge on the cover member;

a bead extending outwardly from the peripheral edge of the cover member; and the bead fitting into the groove to stabilize the assembly of the cover member and the base member.

20. The portable dispenser for generally spherical confectioneries of claim 18 in which the means for stabilizing the assembly of the cover member and the base member includes:

a number of slots extending upwardly into the peripheral wall from the bottom; and a number of lugs on the cover member, corresponding to the number of slots, and configured and disposed so as to fit into a respective slot to stabilize the assembly of the cover member to the base member.

21. The portable dispenser for generally spherical confectioneries of claim 1 in which the means for moving the means for closing the opening in the peripheral wall of the base member includes an actuator secured to the reservoir for movement with the reservoir.

22. The portable dispenser for generally spherical confectioneries of claim 1 in which the means for moving the means for closing the opening in the peripheral wall of the base member includes a pair of spaced apart actuators secured to the reservoir for movement with the reservoir and depending from the reservoir.

23. The portable dispenser for generally spherical confectioneries of claim 22 in which:

the base member includes a ledge disposed below the top of the base member;

the ledge has a pair of spaced-apart slots;

each of the actuators has a free end; and the free end extends into and through a respective one of the slots in the ledge.

24. The portable dispenser for generally spherical confectioneries of claim 23 in which:

means for receiving a single confectionery piece from the reservoir and for conveying the single confectionery piece to the opening in the peripheral wall of the base member are mounted for movement within the substantially hollow interior of the base member; and the free ends of the actuators engage the means for receiving and conveying a single confectionery piece to effect movement of the means for receiving and conveying the single confectionery piece upon movement of the reservoir toward the base in opposition to the means for biasing the reservoir away from the base.

25. The portable dispenser for generally spherical confectioneries of claim 23 in which:

each of the actuators includes a detent between the free end and the reservoir;

the detent engages the ledge to prevent removal of the actuator through the slots once the detent has passed through the slot upon insertion of the actuator into its respective slot.

26. The portable dispenser for generally spherical confectioneries of claim 1 including means for engaging the means for closing the opening in the peripheral wall in the open position projecting upwardly from the cover member.

27. The portable dispenser for generally spherical confectioneries of claim 26 in which:

the means for closing the opening in the peripheral wall of the base member includes a door;

the door has a lower lip;

the cover member includes an upwardly projecting hook; and the lower lip of the door engages the hook projecting upwardly from the cover member to direct the door in moving back to the closed position prohibiting the passage of the confectionery pieces through the opening in the peripheral wall of the base member.

28. The portable dispenser for generally spherical confectioneries of claim 1 including:

a pin extending upwardly from the cover member into the substantially hollow interior;

a guide rod extending downwardly from adjacent the top of the base member into the substantially hollow interior; and each of the pin and guide rod cooperating with the means for closing the opening in the peripheral wall of the base member for movement between the closed position prohibiting the passage of the confectionery pieces through the opening of the peripheral wall of the base member and the open position permitting the passage of the confectionery pieces through the opening of the peripheral wall of the base member.

* * * * *

UNITED STATES PATENT AND TRADEMARK OFFICE

CERTIFICATE OF CORRECTION

PATENT NO. : 5,385,267

DATED : January 31, 1995

INVENTOR(S) : Sidney Diamond and Dennis Kupperman

It is certified that error appears in the above-indentified patent and that said Letters Patent is hereby corrected as shown below:

| | |
|---|---|
| Col. 6, Line 63 | After "tubular collar" delete "56" and insert --156--. |
| Col. 9, Line 3 | After "top and a bottom" delete ":" and insert ";". |

Signed and Sealed this

Twenty-third Day of May, 1995

*Attest:*

*Attesting Officer*

Bruce Lehman

BRUCE LEHMAN

*Commissioner of Patents and Trademarks*